US007018012B2

(12) United States Patent
Edelen et al.

(10) Patent No.: US 7,018,012 B2
(45) Date of Patent: Mar. 28, 2006

(54) MICROFLUID EJECTION DEVICE HAVING EFFICIENT LOGIC AND DRIVER CIRCUITRY

(75) Inventors: J. Glenn Edelen, Versailles, KY (US); George K. Parish, Winchestar, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 334 days.

(21) Appl. No.: 10/713,483

(22) Filed: Nov. 14, 2003

(65) Prior Publication Data

US 2005/0104928 A1 May 19, 2005

(51) Int. Cl.
*B41J 2/15* (2006.01)
*B41J 2/145* (2006.01)
*B41J 2/05* (2006.01)

(52) U.S. Cl. ..... 347/40; 347/59

(58) Field of Classification Search ..... None
See application file for complete search history.

(56) References Cited

U.S. PATENT DOCUMENTS

| | | | | |
|---|---|---|---|---|
| 4,308,549 | A | 12/1981 | Yeh | |
| 4,472,875 | A | 9/1984 | Christian et al. | |
| 4,567,353 | A | 1/1986 | Aiba | |
| 4,947,192 | A | 8/1990 | Hawkins et al. | |
| 5,010,355 | A | 4/1991 | Hawkins et al. | |
| 5,055,859 | A | 10/1991 | Wakabayashi et al. | |
| 5,075,250 | A | 12/1991 | Hawkins et al. | |
| 5,081,473 | A * | 1/1992 | Hawkins et al. | 347/59 |
| 5,913,111 | A | 6/1999 | Kataoka et al. | |
| 6,102,528 | A * | 8/2000 | Burke et al. | 347/59 |
| 6,302,504 | B1 | 10/2001 | Imanaka et al. | |
| 6,365,917 | B1 | 4/2002 | Yamazaki | |
| 6,422,676 | B1 | 7/2002 | Torgerson et al. | |
| 6,478,404 | B1 | 11/2002 | Torgerson et al. | |
| 6,488,363 | B1 | 12/2002 | Torgerson et al. | |
| 6,523,935 | B1 | 2/2003 | Torgerson et al. | |
| 6,592,207 | B1 | 7/2003 | Silverbrook | |
| 6,666,545 | B1 * | 12/2003 | Liu et al. | 347/58 |
| 2001/0035863 | A1 | 11/2001 | Kimura | |
| 2002/0125511 | A1 | 9/2002 | Shimotsusa | |

FOREIGN PATENT DOCUMENTS

| | | |
|---|---|---|
| JP | 2134256 | 5/1990 |
| JP | 3205833 | 9/1991 |
| WO | 0061372 | 10/2000 |

* cited by examiner

*Primary Examiner*—Thinh Nguyen
(74) *Attorney, Agent, or Firm*—Luedeka, Neely & Graham, P.C.

(57) ABSTRACT

A semiconductor substrate for a microfluid ejection head. The substrate includes a plurality of fluid ejection actuators disposed on the substrate. A plurality of driver transistors are disposed on the substrate for driving the plurality of fluid ejection actuators. Each of the driver transistors have an active area ranging from about 1000 to less than about 15,000 $\mu m^2$. A plurality of logic circuits including at least one logic transistor are coupled to the driver transistors. The driver and logic transistors are provided by a high density array of MOS transistors wherein at least the logic transistors have a gate length of from about 0.1 to less than about 3 microns.

30 Claims, 9 Drawing Sheets

Fig. 1
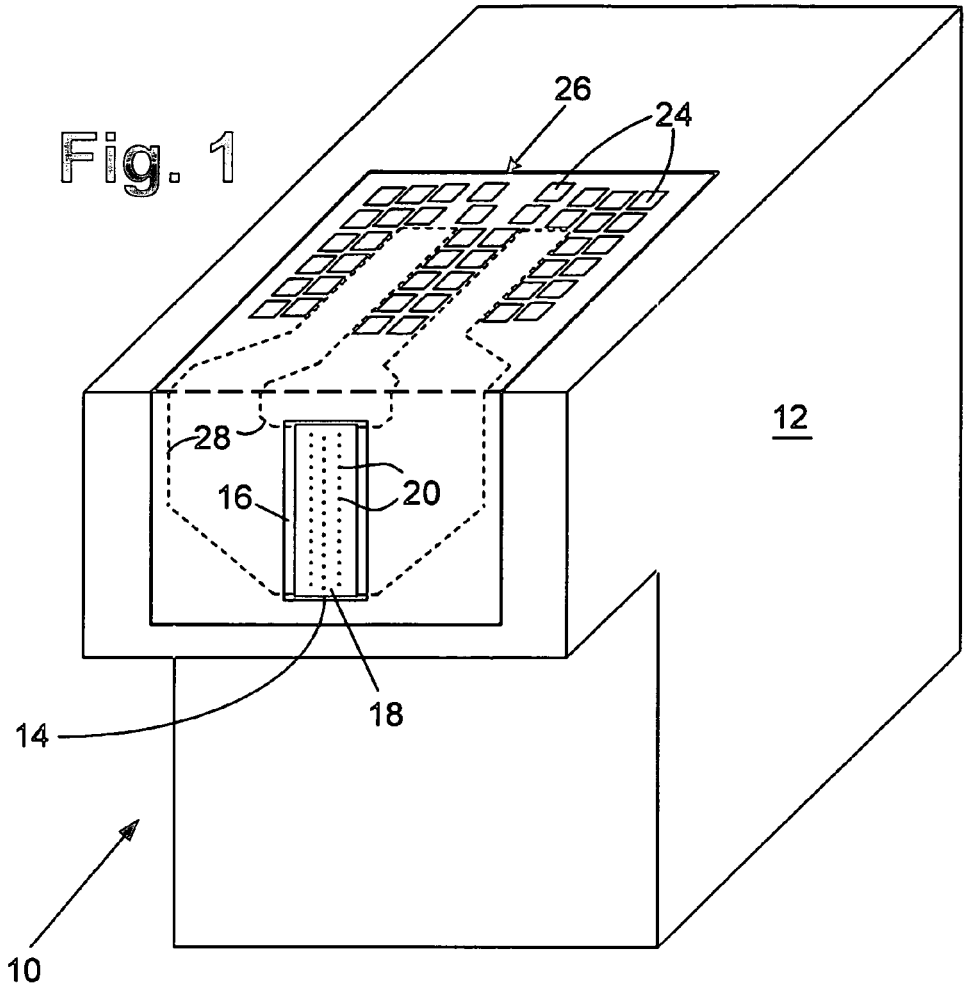
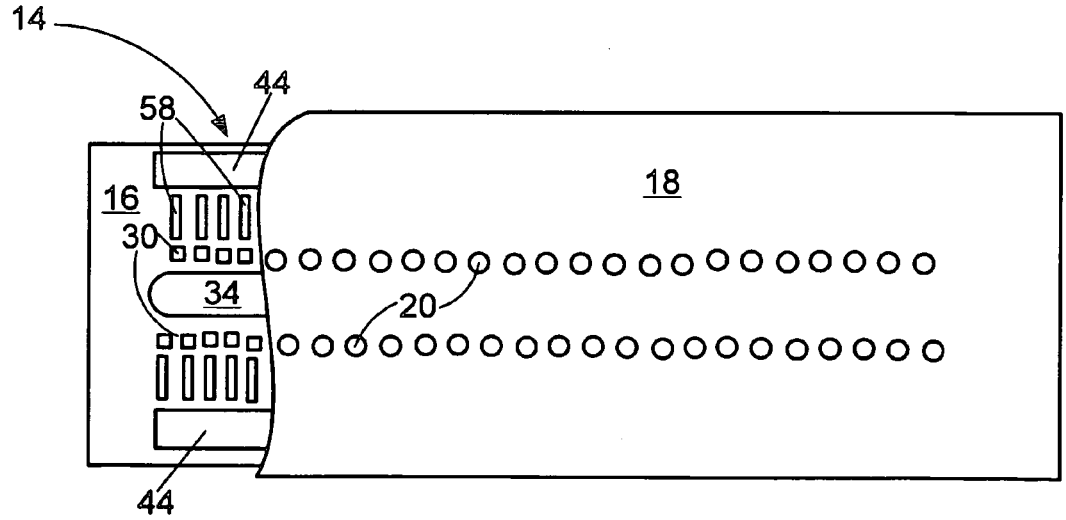
Fig. 10

MICROFLUID EJECTION DEVICE HAVING EFFICIENT LOGIC AND DRIVER CIRCUITRY

FIELD OF THE INVENTION

The invention relates to microfluid ejection devices and in particular to ejection heads for ejection devices containing efficient logic and driver circuitry.

BACKGROUND OF THE INVENTION

Microfluid ejection devices such as ink jet printers continue to experience wide acceptance as economical replacements for laser printers. Such ink jet printers are typically more versatile than laser printers for some applications. As the capabilities of ink jet printers are increased to provide higher quality images at increased printing rates, ejection heads, which are the primary printing components of ink jet printers, continue to evolve and become more complex. As the complexity of the ejection heads increases, so does the cost for producing ejection heads. Nevertheless, there continues to be a need for microfluid ejection devices having enhanced capabilities including increased quality and higher throughput rates. Competitive pressure on print quality and price promote a continued need to produce ejection heads with enhanced capabilities in a more economical manner.

SUMMARY OF THE INVENTION

With regard to the foregoing and other objects and advantages there is provided semiconductor substrate for a microfluid ejection head. The substrate includes a plurality of fluid ejection actuators disposed on the substrate. A plurality of driver transistors are disposed on the substrate for driving the plurality of fluid ejection actuators. Each of the driver transistors have an active area ranging from about 1000 to less than about 15,000 $\mu m^2$. A plurality of logic circuits including at least one logic transistor are coupled to the driver transistors. The driver and logic transistors are provided by a high density array of MOS transistors wherein at least the logic transistors have a gate length of from about 0.1 to less than about 3 microns.

In another embodiment there is provided a microfluid ejection cartridge for a microfluid ejection device. The cartridge body has a fluid supply source and an ejection head attached to the cartridge body in fluid communication with the fluid supply source. The ejection head includes a semiconductor substrate having a plurality of fluid ejection actuators disposed on the substrate. A plurality of driver transistors disposed on the substrate for driving the plurality of fluid ejection actuators. Each of the driver transistors have an active area width ranging from about 100 to less than about 400 microns. A plurality of logic circuits including at least one logic transistor are operatively coupled to the driver transistors. The driver and logic transistors comprise a high density array of MOS transistors wherein at least the logic transistor has a gate length of from about 0.1 to less than about 3 microns. A nozzle plate is attached to the semiconductor substrate for ejecting fluid therefrom upon activation of the fluid ejection actuators.

In yet another embodiment there is provided a semiconductor substrate for an ink jet printhead. The substrate includes a plurality of heater resistors disposed on the substrate. The heater resistors have a protective layer of diamond like carbon with a thickness ranging from about 1000 to about 3000 Angstroms. A plurality of driver transistors are disposed on the substrate for driving the plurality of fluid ejection actuators. A plurality of logic circuits including at least one logic transistor are coupled to the driver transistors. The driver and logic transistors provide a high density array of MOS transistors wherein at least the logic transistors have a gate length of from about 0.1 to less than about 3 microns.

An advantage of the invention is that it provides microfluid ejection heads for microfluid ejection devices that require substantially less substrate area yet provide increased functionality. The semiconductor substrates may be used for a wide variety of applications including ink jet printheads, microfluid cooling devices, delivery of controlled amounts of pharmaceutical preparations, and the like. In ink jet printer applications, the substrates of the invention can significantly reduce the manufacturing and raw material costs of the printheads incorporating the ejection heads.

BRIEF DESCRIPTION OF THE DRAWINGS

Further advantages of the invention will become apparent by reference to the detailed description of preferred embodiments when considered in conjunction with the following drawings illustrating one or more non-limiting aspects of the invention, wherein like reference characters designate like or similar elements throughout the several drawings as follows:

FIG. 1 is a micro-fluid ejection device cartridge, not to scale, containing a microfluid ejection head according to the invention;

FIG. 10 is a plan view not to scale of a typical layout on a substrate for a microfluid ejection head according to the invention;

DETAILED DESCRIPTION OF THE INVENTION

With reference to FIG. 1, a fluid cartridge 10 for a microfluid ejection device is illustrated. The cartridge 10 includes a cartridge body 12 for supplying a fluid to a fluid ejection head 14. The fluid may be contained in a storage area in the cartridge body 12 or may be supplied from a remote source to the cartridge body.

Figure 2:
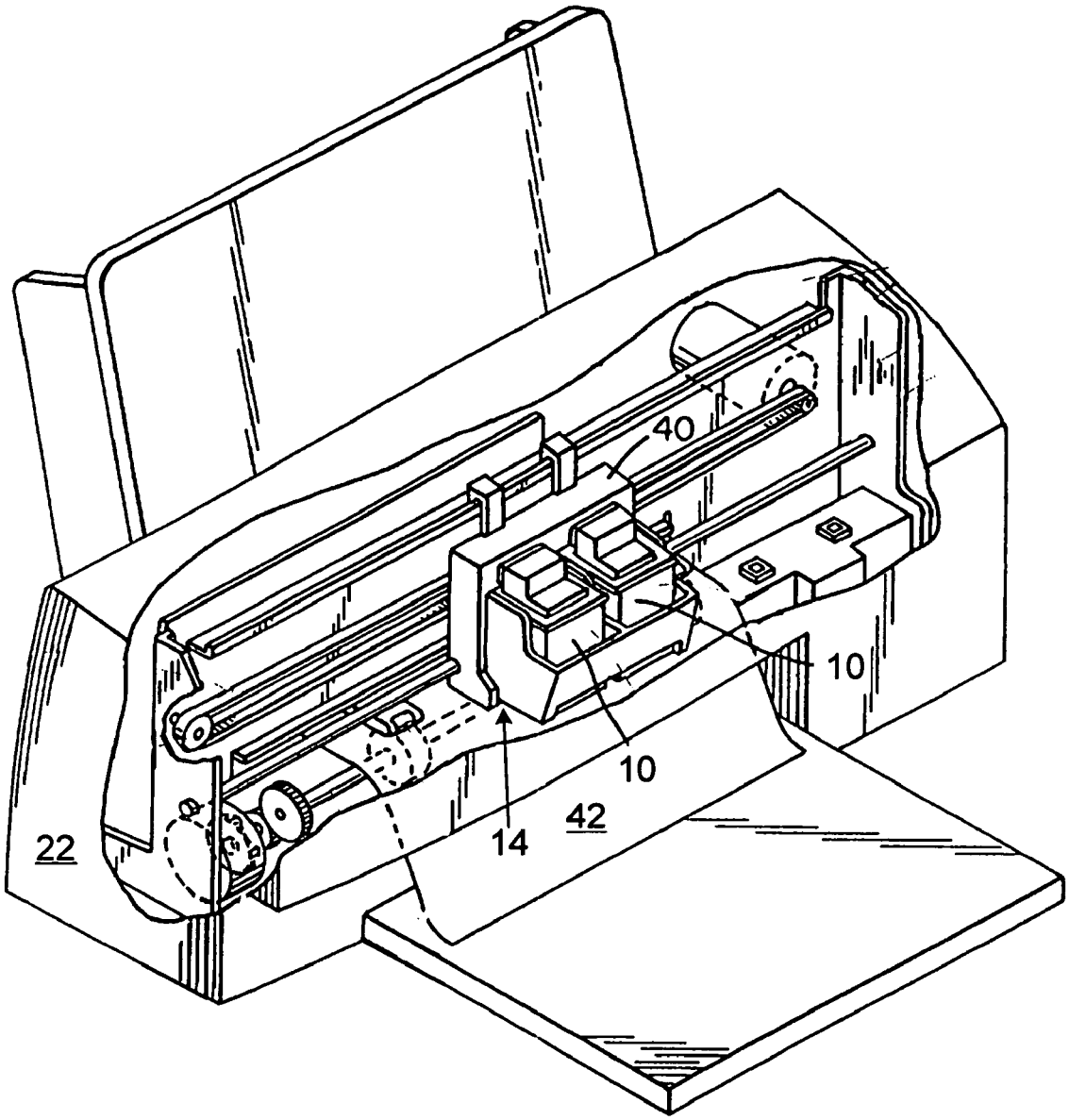
FIG. 2 is a perspective view of a preferred microfluid ejection device according to the invention.

The fluid ejection head 14 includes a semiconductor substrate 16 and a nozzle plate 18 containing nozzle holes 20. It is preferred that the cartridge be removably attached to a micro-fluid ejection device such as an ink jet printer 22 (FIG. 2). Accordingly, electrical contacts 24 are provided on a flexible circuit 26 for electrical connection to the microfluid ejection device. The flexible circuit 26 includes electrical traces 28 that are connected to the substrate 16 of the fluid ejection head 14.

Figure 3:
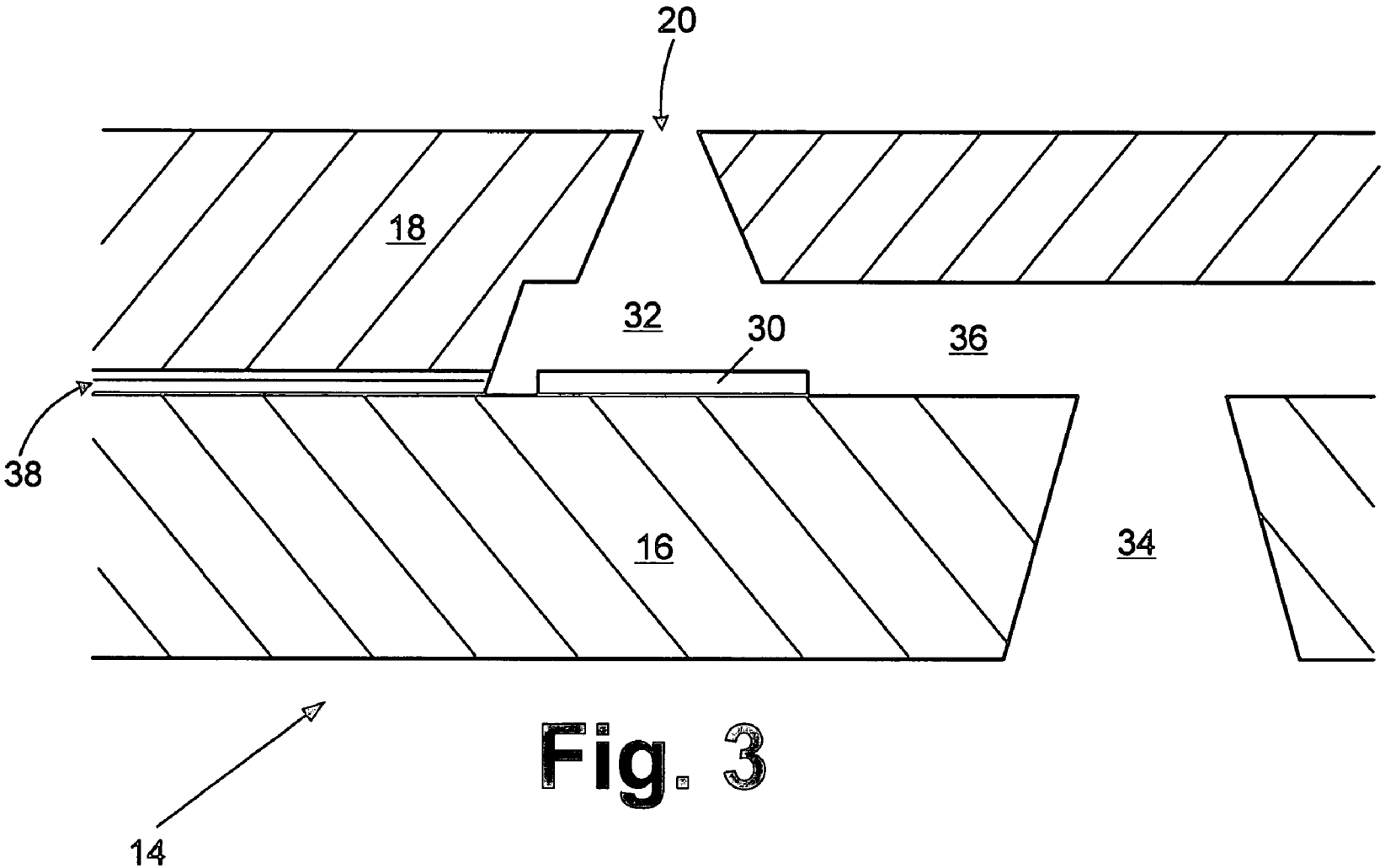
FIG. 3 is a cross-sectional view, not to scale of a portion of a microfluid ejection head according to the invention.

An enlarged view, not to scale, of a portion of the fluid ejection head 14 is illustrated in FIG. 3. In this case, the fluid ejection head 14 contains a thermal heating element 30 as a fluid ejection actuator for heating the fluid in a fluid chamber 32 formed in the nozzle plate 18 between the substrate 16 and a nozzle hole 20. However, the invention is not limited to a fluid ejection head 14 containing a thermal heating element 30. In the case of thermal heating elements 30, the heating elements are heater resistors preferably having a protective layer comprising diamond like carbon with a thickness ranging from about 1000 to about 3000 Angstroms. Other fluid ejection actuators, such as piezoelectric devices may also be used to provide a fluid ejection head according to the invention.

Fluid is provided to the fluid chamber 32 through an opening or slot 34 in the substrate 16 and through a fluid channel 36 connecting the slot 34 with the fluid chamber 32. The nozzle plate 18 is preferably adhesively attached to the substrate 16 as by adhesive layer 36. As depicted in FIG. 3, the flow features including the fluid chamber 32 and fluid channel 36 are formed in the nozzle plate 18. However, the flow features may be provided in a separate thick film layer and wherein a nozzle plate containing only nozzle holes is attached to the thick film layer. In a particularly preferred embodiment, the fluid ejection head 14 is a thermal or piezoelectric ink jet printhead. However, the invention is not intended to be limited to ink jet printheads as other fluids may be ejected with a microfluid ejection device according to the invention.

Referring again to FIG. 2, the fluid ejection device is preferably an ink jet printer 22. The printer 22 includes a carriage 40 for holding one or more cartridges 10 and for moving the cartridges 10 over a media 42 such as paper depositing a fluid from the cartridges 10 on the media 42. As set forth above, the contacts 24 on the cartridge mate with contacts on the carriage 40 for providing electrical connection between the printer 22 and the cartridge 10. Microcontrollers in the printer 22 control the movement of the carriage 40 across the media 42 and convert analog and/or digital inputs from an external device such as a computer for controlling the operation of the printer 22. Ejection of fluid from the fluid ejection head 14 is controlled by a logic circuit 44 on the fluid ejection head 14 in conjunction with the controller in the printer 22.

Figure 4:
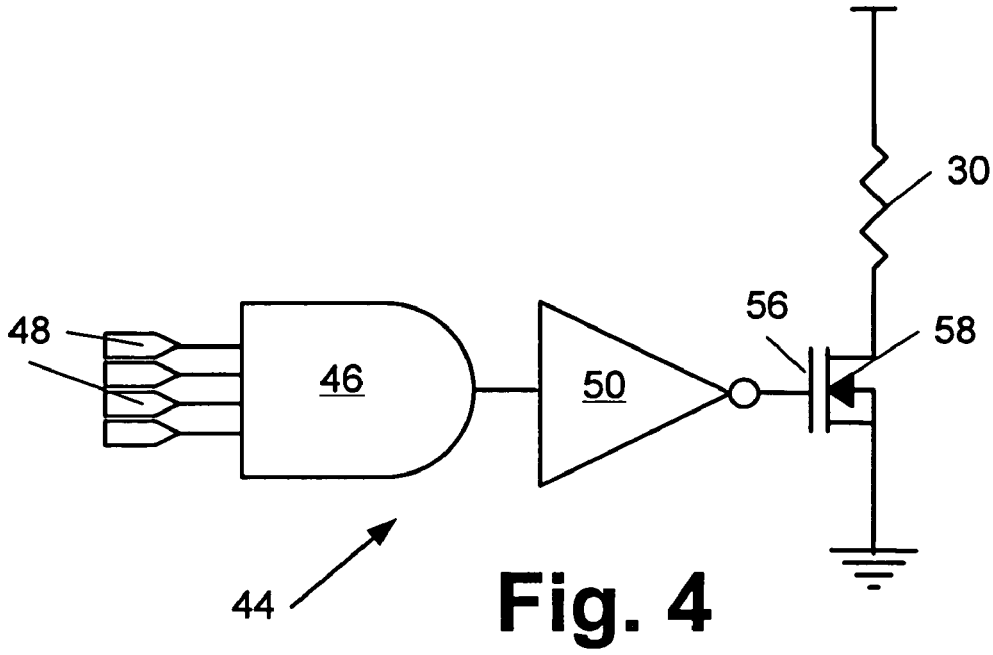
FIG. 4 is a schematic drawing of a logic circuit according to the invention.
Figure 5:
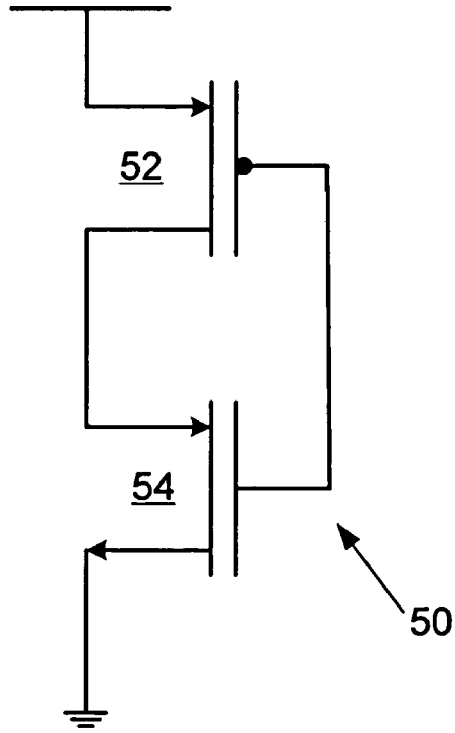
FIG. 5 is a schematic drawing of an inverter for a logic circuit according to the invention.

FIGS. 4 and 5, illustrate a preferred logic circuit 44 for a fluid ejection head 14. The logic circuit 44 includes a NAND gate 46 with inputs 48 from the microfluid ejection device or printer 22 and has an output to an inverter 50. A preferred inverter 50 is CMOS logic circuit illustrated in FIG. 5 and includes a NMOS transistor 52 in a P-type substrate and an adjacent PMOS transistor 54 provided by an NWELL in a P-type substrate. The output of the inverter 50 is tied to a gate 56 of a driver transistor 58 that drives the fluid actuator, in this case a thermal heating element 30. There is at least one driver transistor 58 adjacent each heater element 30. The heater element 30 is preferably a resistor having a resistance ranging from about 70 to about 150 ohms or more, more preferably from about 100 to about 120 ohms.

Figure 6:
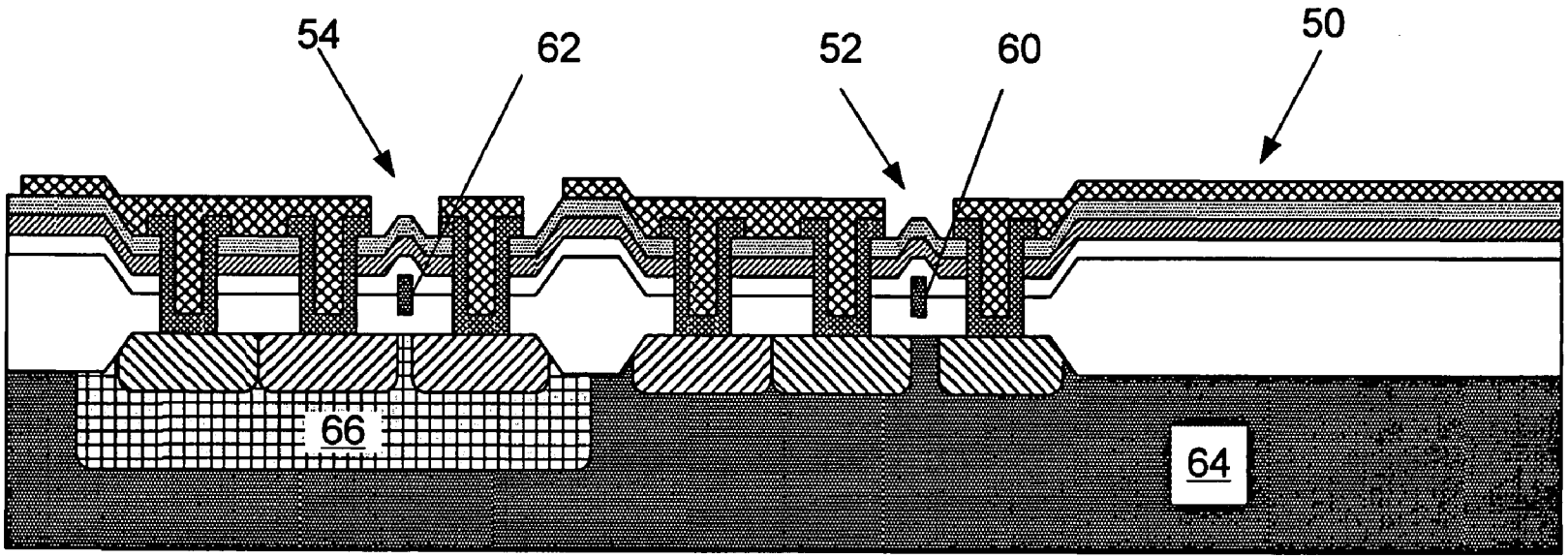
FIG. 6 is a cross-sectional view, not to scale, of a portion of logic circuit transistors according to the invention.

A cross-sectional view, not to scale of an inverter 50 as described above is illustrated in FIG. 6. As set forth above, the inverter 50 includes an NMOS transistor 52 and a PMOS transistor 54. Each of the transistors 52 and 54 preferably have gates 60 and 62 that have gate lengths ranging from about 0.1 to less than about 3 microns, most preferably from about 0.1 to about 1.5 microns. Likewise the channels in the substrate 64 or NWELL 66 preferably have channel length ranging from about 0.1 to less than about 3 microns. By providing smaller gate and channel length, a higher density of transistors 52 and 54 may be provided for an area of a substrate containing the logic circuit 44. Other features of the transistors 52 and 54 are conventional and the inverter 50 is produced by conventional semiconductor processing techniques.

Figure 7:
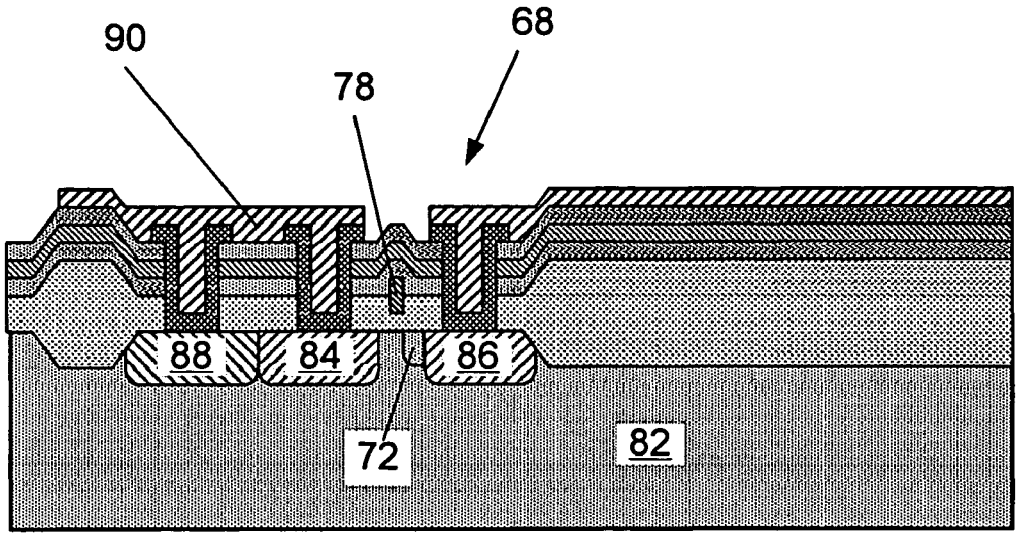
FIGS. 7 and 8 are cross-sectional views, not to scale of portions of driver transistors according to the invention.
Figure 8:
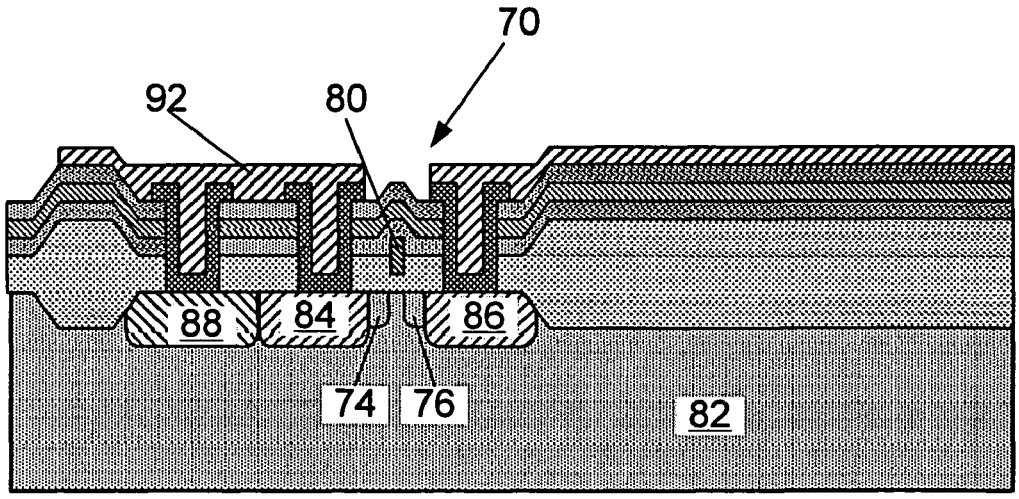
Figure 9:
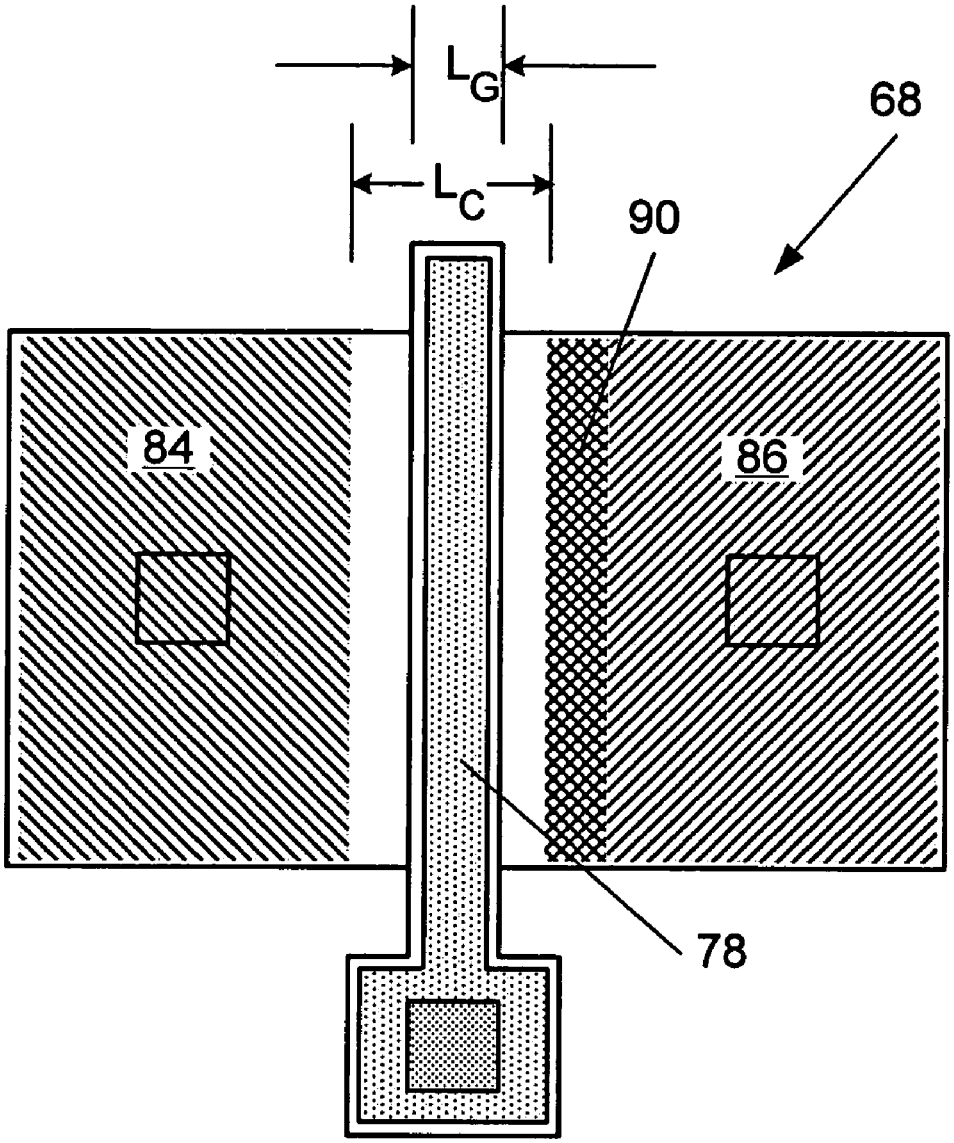
FIG. 9 is a plan view, not to scale, of a portion of a driver transistor according to the invention.

Cross-sectional views, not to scale of preferred driver transistors 68 and 70 are illustrated in FIGS. 7 and 8. FIG. 9 is a simplified plan view of driver transistor 68. FIG. 7 is a driver transistor 68 having a lightly doped drain region 72, whereas driver transistor 70 contains both a lightly doped source region 74 and a lightly doped drain region 76. It is also preferred that the driver transistors 68 and 70 include gates 78 and 80 having gate lengths $L_G$ ranging from about 0.1 to less than about 3 microns and preferably from about 0.1 to about 1.5 microns and channels having channel lengths $L_C$ (FIG. 9) ranging from about 0.1 to less than about 3 microns. The gate length $L_G$ of the driver transistors 68 and 70 enables driver transistors having lower resistance. Typically the resistance of the driver transistors 68 and 70 is less than 10% of a total resistance provided in the circuit by the heater resistors 30, logic circuit 44, driver transistor 68 or 70, and associated connective circuitry. Such driver transistors 68 and 70 are preferably operated at a voltage of greater than 8 volts, preferably from about 8 to about 12 volts.

The driver transistor 68 or 70 includes a substrate 82 which is preferably a P-type silicon substrate. Areas 84 and 86 are N-doped source and drain regions for transistors 68 and 70. Area 88 is a P-doped region that provides zero potential for the transistor source contacts 90 and 92. Other features of the driver transistors 68 and 70 are conventional and the transistors 68 and 70 are made by conventional semiconductor processing techniques. It is preferred that the driver transistor 68 or 70 have an on resistance of less than about 20 ohms, preferably from about 1 to less than about 20 ohms.

A plan view, not to scale of a fluid ejection head 14 is shown in FIG. 10. The fluid ejection head 14 includes a semiconductor substrate 16 and a nozzle plate 18 attached to the substrate 16. A layout of device areas of the semiconductor substrate 16 is shown providing preferred locations for logic circuitry 44, driver transistors 58, and heater resistors 30. As shown in FIG. 10, the substrate 16 includes a single slot 34 for providing fluid such as ink to the heater resistors 30 that are disposed on both sides of the slot 34. However, the invention is not limited to a substrate 16 having a single slot 34 or to fluid ejection actuators such as heater resistors 30 disposed on both sides of the slot 34. Other substrates according to the invention may include multiple slots with fluid ejection actuators disposed on one or both sides of the slots. The substrate may also include no slots 34, whereby fluid flows around the edges of the substrate 16 to the actuators. Rather than a single slot 34, the substrate 16 may include multiples or openings, one each for one or more actuator devices. The nozzle plate 18, preferably made of an ink resistant material such as polyimide is attached to the substrate 16.

Figure 11:
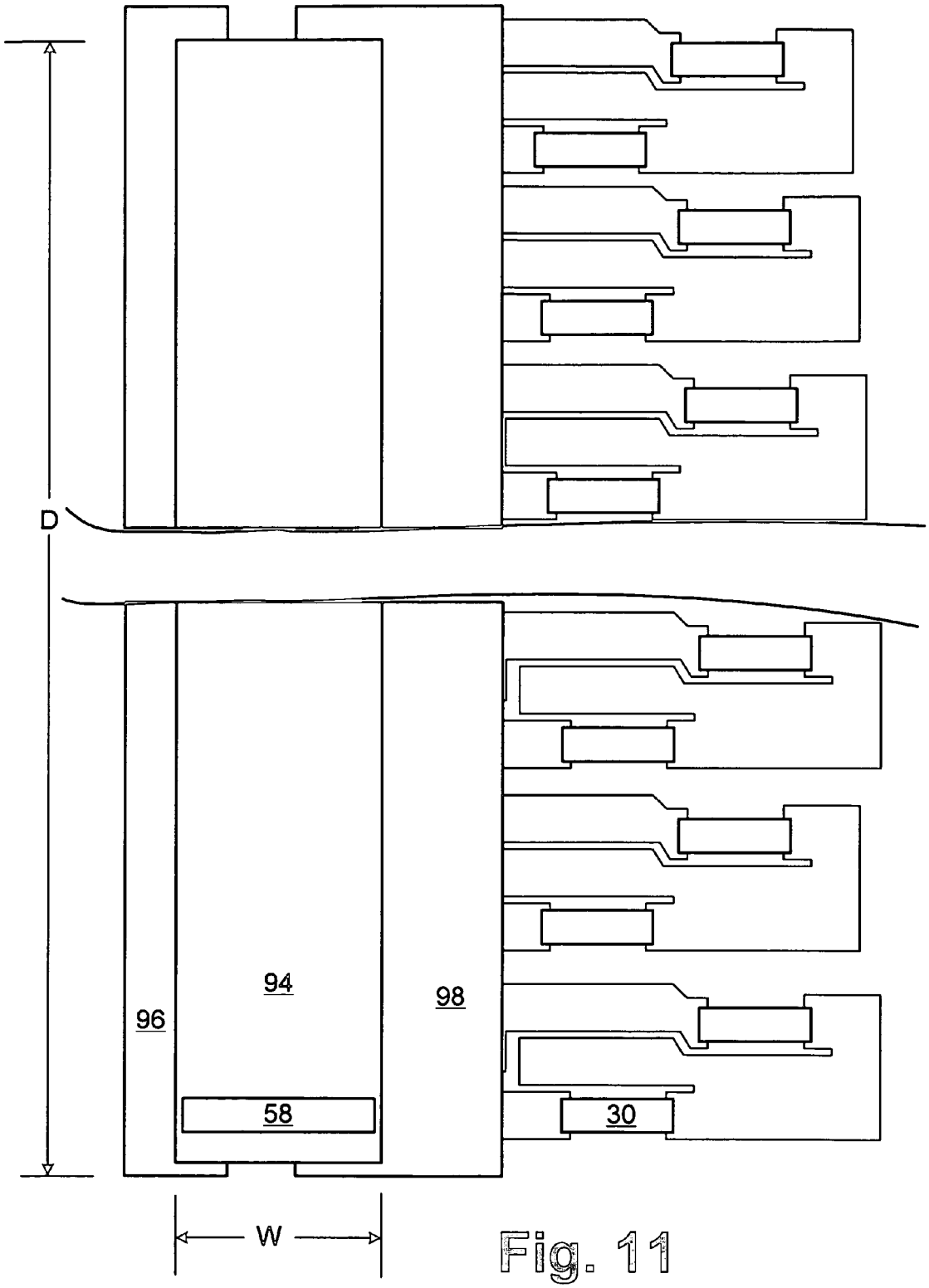
FIG. 11 is a plan view, not to scale of a portion of an active area of a microfluid ejection head according to the invention.

An active area 94 required for the driver transistors 58 is illustrated in detail in a plan view of the active area 94 in FIG. 11. This figure represents a portion of a typical heater array and active area. The active area 94 of the substrate 16 preferably has a width dimension W ranging from about 100 to about 400 microns and an overall length dimension D ranging from about 6,300 microns to about 26,000 microns. The driver transistors 58 are provided at a pitch P ranging from about 10 microns to about 84 microns. A ground bus 96 and a power bus 98 are provided to provide power to the devices in the active area 94 and to the heater resistors 30.

In a particularly preferred embodiment, the area of a single driver transistor 58 in the semiconductor substrate 16 has an active area width ranging from about 100 to less than about 400 microns and an active area of preferably less than about 15,000 $\mu m^2$. The smaller active area 94 is made possible by use of driver transistors 58 having gates lengths and channel lengths ranging from about 0.1 to less than about 3 microns as described above. Likewise a smaller area is require for the logic circuit 44 (FIG. 10) because of the use of transistors 52 and 54 having gate lengths ranging from about 0.1 to less than about 3 microns.

Figure 12:
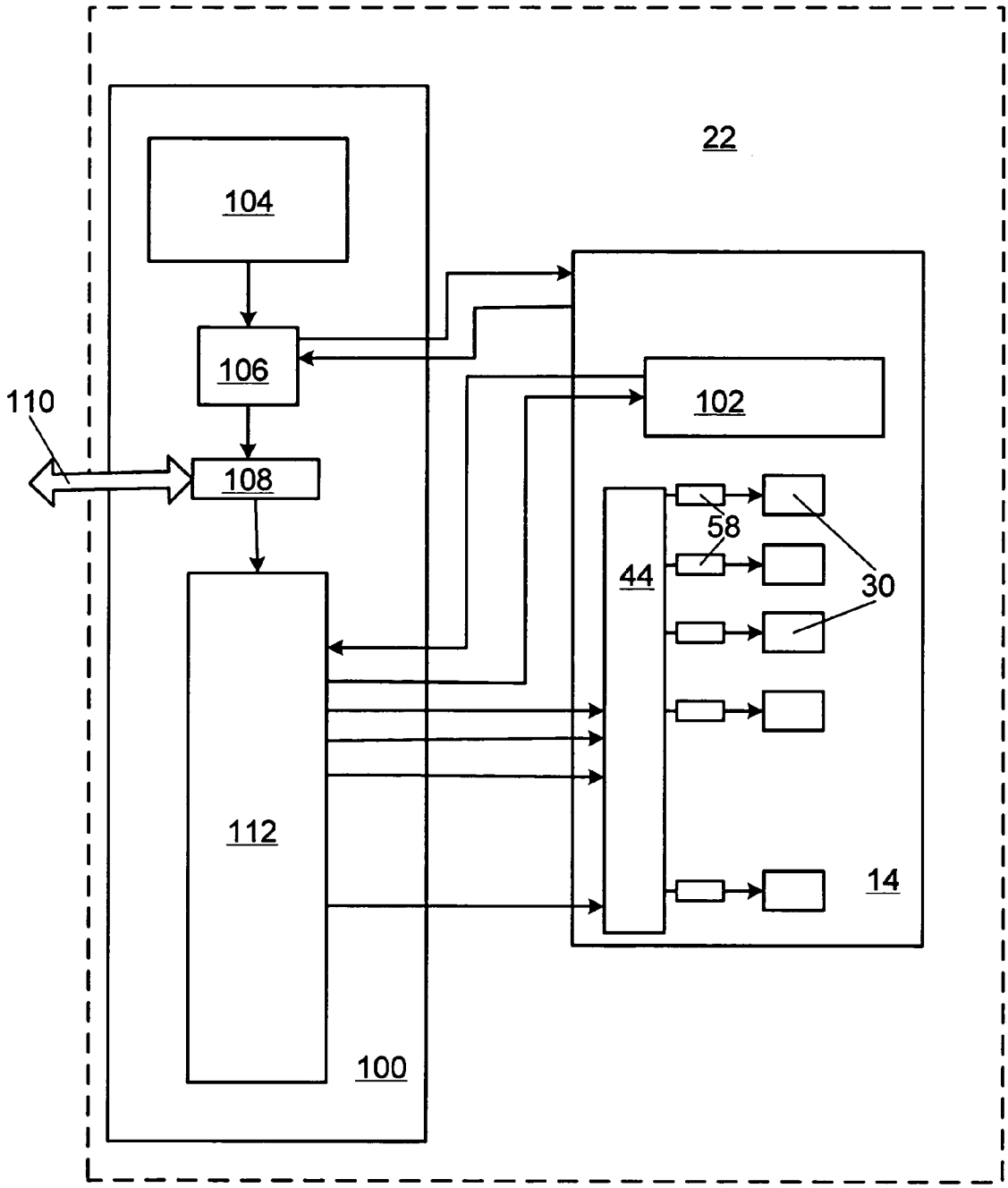
FIG. 12 is a partial schematic drawing of a logic diagram for a microfluid ejection device according to the invention.

FIG. 12 is a partial simplified logic diagram for a micro fluid ejection device such as a printer 22 (FIG. 2) according to the invention. The device includes a main control system 100 connected to the fluid ejection head 14. As described above with reference to FIG. 10, the fluid ejection head 14 includes logic circuitry 44, device drivers 58 and fluid ejection actuators 30 connected to the device drivers 58. A programmable memory device 102 may be located on the ejection head 14 or in the control system 100 of the printer 22. The printer 22 includes a power supply 104 and an AC to DC converter 106. The AC to DC converter 106 provides power to the ejection head 14 and to an analog to digital converter 108. The analog to digital converter 108 accepts a signal 110 from an external source such as a computer and provides the signal to a controller 112 in the printer 22. The controller 112 contains logic devices, for controlling the function of the ejection head 14. The controller 112 also contains local memory and logic circuits for programming and reading the memory 102, if any, on the ejection head 14.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A semiconductor substrate for a microfluid ejection head, the substrate comprising:

a plurality of fluid ejection actuators disposed on the substrate;

a plurality of driver transistors disposed on the substrate for driving the plurality of fluid ejection actuators, each of the driver transistors having an active area ranging from about 1000 to less than about 15,000 $\mu m^2$; and a plurality of logic circuits comprising at least one logic transistor are coupled to the driver transistors, wherein each of the driver and logic transistors comprise a high density array of MOS transistors wherein at least the logic transistors have a gate length of from about 0.1 to less than about 3 microns.

2. The semiconductor substrate of claim 1 wherein the fluid ejection actuators comprise heater resistors.

3. The semiconductor substrate of claim 2 wherein the heater resistors have a resistance ranging from about 70 to about 150 ohms.

4. The semiconductor substrate of claim 1 wherein the driver transistors comprises transistors having a lightly doped drain region.

5. The semiconductor substrate of claim 1 wherein the driver transistors have an active area width ranging from about 100 to less than about 400 microns.

6. The semiconductor substrate of claim 1 wherein the logic circuits are configured to select a gate of the driver transistors for driving the ejection actuators.

7. The semiconductor substrate of claim 1 wherein the driver transistors have an on resistance of less than about 20 ohms.

8. The semiconductor substrate of claim 1 wherein the driver transistors comprise transistors having lightly doped source and drain regions.

9. The semiconductor substrate of claim 1 wherein the driver transistors comprise transistors having a gate length ranging from about 0.1 to less than about 3 microns.

10. The semiconductor substrate of claim 1 wherein the driver transistors comprise transistors having a channel length ranging from about 0.1 to less than about 3 microns.

11. A printhead for an ink jet printer containing the semiconductor substrate of claim 1.

12. The printhead of claim 11 wherein the fluid ejection actuators comprise heater resistors and the heater resistors have a protective layer comprising diamond like carbon with a thickness ranging from about 1000 to about 3000 Angstroms.

13. A microfluid ejection cartridge for a microfluid ejection device comprising:

a cartridge body having a fluid supply source and an ejection head attached to the cartridge body in fluid communication with the fluid supply source, the ejection head comprising:

a semiconductor substrate having a plurality of fluid ejection actuators disposed on the substrate;

a plurality of driver transistors disposed on the substrate for driving the plurality of fluid ejection actuators, each of the driver transistors having an active area width ranging from about 100 to less than about 400 microns; and a plurality of logic circuits comprising at least one logic transistor operatively coupled to the driver transistors, wherein each of the driver and logic transistors comprise a high density array of MOS transistors wherein at least the logic transistor has a gate length of from about 0.1 to less than about 3 microns; and a nozzle plate attached to the semiconductor substrate for ejecting fluid therefrom upon activation of the fluid ejection actuators.

14. The microfluid ejection cartridge of claim 13 wherein the fluid ejection actuators comprise heater resistors having a resistance ranging from about 70 to about 150 ohms.

15. The microfluid ejection cartridge of claim 13 wherein the active area of the substrate for each of the driver transistors ranges from about 1000 to less than about 15,000 $\mu m^2$.

16. The microfluid ejection cartridge of claim 13 wherein the driver transistors comprise transistors having a lightly doped drain region.

17. The microfluid ejection cartridge of claim 13 wherein the logic circuits are configured to select a gate of the driver transistors for driving the ejection actuators.

18. The microfluid ejection cartridge of claim 13 wherein the driver transistors have an on resistance of less than about 20 ohms.

19. The microfluid ejection cartridge of claim 13 wherein the driver transistors comprise transistors having lightly doped source and drain regions.

20. The microfluid ejection cartridge of claim 13 wherein the fluid ejection actuators comprise heater resistors and the heater resistors have a protective layer comprising diamond like carbon with a thickness ranging from about 1000 to about 3000 Angstroms.

21. The microfluid ejection cartridge of claim 13 wherein the driver transistors comprise transistors having a gate length ranging from about 0.1 to less than about 3 microns.

22. A semiconductor substrate for an ink jet printhead, the substrate comprising:

a plurality of heater resistors disposed on the substrate, the heater resistors having a protective layer comprising diamond like carbon with a thickness ranging from about 1000 to about 3000 Angstroms;

a plurality of driver transistors disposed on the substrate for driving the plurality of fluid ejection actuators; and a plurality of logic circuits comprising at least one logic transistor are coupled to the driver transistors, wherein each of the driver and logic transistors comprise a high density array of MOS transistors wherein at least the logic transistors have a gate length of from about 0.1 to less than about 3 microns.

23. The semiconductor substrate of claim 22 wherein the heater resistors have a resistance ranging from about 70 to about 150 ohms.

24. The semiconductor substrate of claim 22 wherein the driver transistors comprises transistors having a lightly doped drain region.

25. The semiconductor substrate of claim 22 wherein the driver transistors have an active area width ranging from about 100 to less than about 400 microns.

26. The semiconductor substrate of claim 22 wherein the logic circuits are configured to select a gate of the driver transistors for driving the ejection actuators.

27. The semiconductor substrate of claim 22 wherein the driver transistors have an on resistance of less than about 20 ohms.

28. The semiconductor substrate of claim 22 wherein the driver transistors comprise transistors having lightly doped source and drain regions.

29. The semiconductor substrate of claim 22 wherein the driver transistors comprise transistors having a gate length ranging from about 0.1 to less than about 3 microns.

30. The semiconductor substrate of claim 22 wherein the driver transistors comprise transistors having a channel length ranging from about 0.1 to less than about 3 microns.

* * * * *